US005800867A

United States Patent [19]

Matsunaga et al.

[11] Patent Number: 5,800,867

[45] Date of Patent: Sep. 1, 1998

[54] DEFLECTION CONTROL OF LIQUID OR POWDER STREAM DURING DISPENSING

[75] Inventors: Masafumi Matsunaga, Shimoda-cho; Ikuo Yamagata, Kujirai; Shigenori Kitasako, Futaba; Akito Takayanagi, Minami-dai, all of Japan

[73] Assignee: Nordson Corporation, Westlake, Ohio

[21] Appl. No.: 728,235

[22] Filed: Oct. 8, 1996

Related U.S. Application Data

[63] Continuation of Ser. No. 203,269, Feb. 28, 1994, abandoned, which is a continuation-in-part of Ser. No. 974,502, Nov. 12, 1992, abandoned, which is a continuation-in-part of Ser. No. 916,988, Aug. 13, 1992, abandoned.

[30] Foreign Application Priority Data

Jan. 2, 1994 [JP] Japan ..... 6-029105

[51] Int. Cl.[6] ..... B05D 7/22

[52] U.S. Cl. ..... 427/236; 427/239; 427/385.5; 427/368.1; 427/421

[58] Field of Search ..... 427/236, 421, 427/385.5, 388.1, 239

[56] References Cited

U.S. PATENT DOCUMENTS

| | | | |
|---|---|---|---|
| 1,608,833 | 11/1926 | Birkenmaier . | |
| 2,740,670 | 4/1956 | Harder . | |
| 3,294,058 | 12/1966 | Shriro | 118/11 |
| 3,296,015 | 1/1967 | Juvinall et al. . | |
| 3,434,865 | 3/1969 | Doquire . | |
| 3,635,400 | 1/1972 | Nord et al. | 239/15 |
| 3,747,852 | 7/1973 | Nord et al. | 239/8 |
| 4,064,295 | 12/1977 | Singer | 427/424 |
| 4,066,177 | 1/1978 | Clark | 164/46 |
| 4,185,981 | 1/1980 | Ohsato et al. | 65/5 |
| 4,219,157 | 8/1980 | Binoche | 239/296 |
| 4,273,293 | 6/1981 | Hastings | 239/705 |
| 4,381,081 | 4/1983 | Hastings | 239/707 |
| 4,544,100 | 10/1985 | Simashkevich et al. | 239/407 |
| 4,647,471 | 3/1987 | Jenkins | 427/37 |
| 4,681,258 | 7/1987 | Jenkins et al. | 239/66 |
| 4,690,372 | 9/1987 | Takai et al. | 239/226 |
| 4,709,858 | 12/1987 | Stern et al. | 239/296 |
| 4,785,996 | 11/1988 | Ziecker et al. | 239/298 |
| 4,894,252 | 1/1990 | Bongen et al. | 427/8 |
| 4,934,445 | 6/1990 | Palata et al. | 164/486 |
| 5,092,265 | 3/1992 | Hughes et al. | 427/236 |
| 5,270,075 | 12/1993 | Robyn et al. | 427/236 |

FOREIGN PATENT DOCUMENTS

| | | |
|---|---|---|
| 568572 | 6/1958 | Belgium . |
| 729469 | 12/1942 | Germany . |
| 803310 | 7/1949 | Germany . |

*Primary Examiner*—Janyce Bell

*Attorney, Agent, or Firm*—Wood, Herron & Evans, L.L.P.

[57] ABSTRACT

A method and apparatus for deflecting a liquid or powder stream during dispensing with a plurality of independently actuatable flows. A gun has a nozzle with an orifice for dispensing a stream. Blowout ports surround the orifice and are aimed at the flow path of the stream, just beyond the end of the gun. The blowout ports are connected via conduits to a pressurized source. A timer actuates solenoid valves to control liquid or powder dispensing through the orifice and flows from the blowout ports. By coordinating liquid or powder dispensing with the directional flows, the stream may be deflected to achieve a desired dot or spray distribution pattern on a substrate or uniform spray coating of the inside surface of a can. Additionally, protective structure may be added to the end of the gun nozzle to eliminate the adverse effects typically caused by accumulation of some deflected liquid at the end of the gun nozzle.

34 Claims, 11 Drawing Sheets

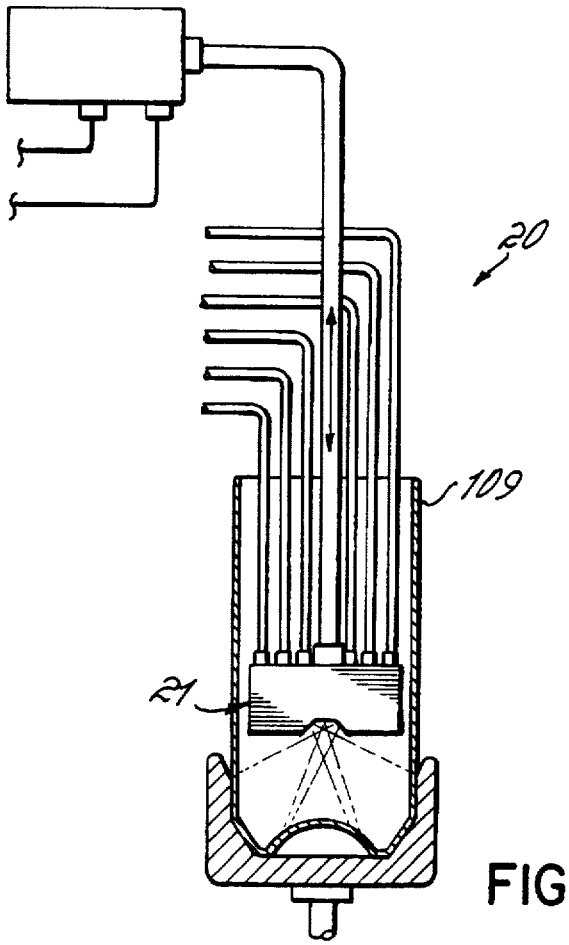
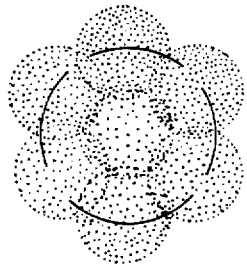
FIG. 18
FIG. 19A
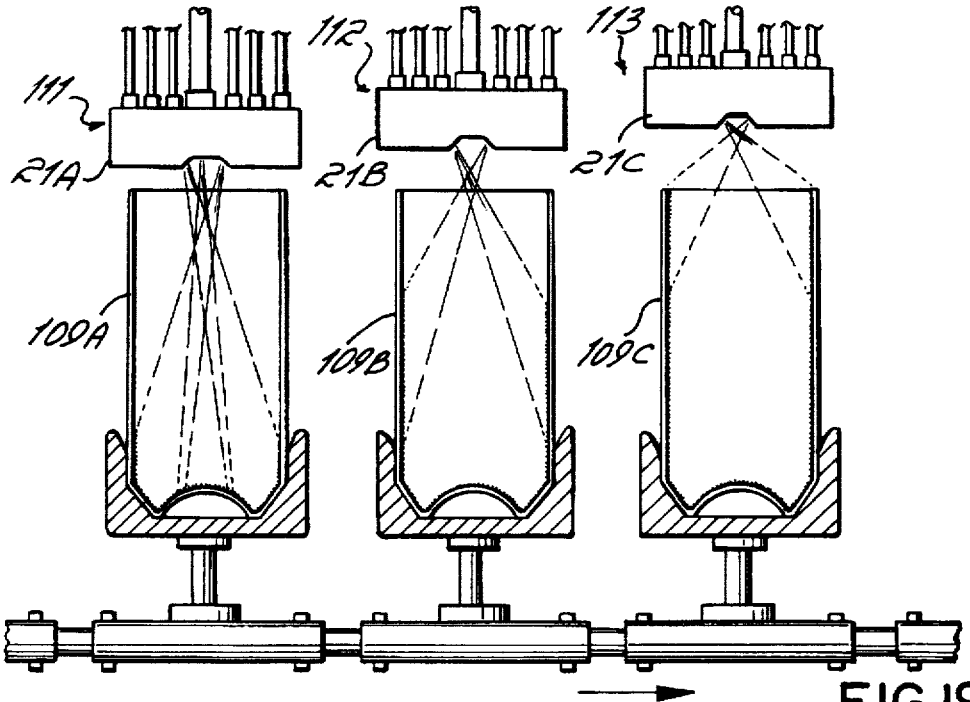
FIG.19B

DEFLECTION CONTROL OF LIQUID OR POWDER STREAM DURING DISPENSING

This application is a continuation of U.S. application Ser. No. 08/203,269, filed on Feb. 28, 1994, abandoned, which is a continuation-in-part of U.S. application Ser. No. 07/974,502, filed on Nov. 12, 1992, abandoned, which is a continuation-in-part of U.S. application Ser. No. 07/916,988, filed Aug. 13, 1992, abandoned.

FIELD OF THE INVENTION

This invention relates to liquid or powder dispensing. More particularly, this invention relates to a method and apparatus for controlled deflection of a liquid or powder stream during dispensing to achieve a complex pattern on a substrate or uniform coating of an irregular surface. One preferred embodiment of the invention relates to uniform coating of the entire interior surface of a metal can with a single nozzle.

BACKGROUND OF THE INVENTION

In the past, a number of methods have been used to achieve a desired spray pattern for a liquid or molten product dispensed from a nozzle opening. Binary liquid spray (air spray) and airless spray are two commonly used methods for discharging a coating agent from a nozzle opening to achieve a spray pattern on a substrate. Differences among spray patterns formed by these and other methods generally relate to the varied ways in which compressed gas is used to generate the spray.

Spraying of compressed air on both sides of a liquid stream may be used to provide another type of spray pattern, or to alter a known spray pattern. With any type of nozzle opening, spraying of air sideways into the liquid stream generally creates a broad deformation of the spray pattern. One method referred to as the swirl spray method creates descending spirals forming a whirlpool by discharging liquid downward through a nozzle opening and spraying a heated, compressed gas in the vicinity of the external periphery of the discharged stream from multiple openings located in regular intervals around the periphery of the nozzle.

With one or more of these methods, it is possible to obtain a uniform spray pattern from a single nozzle. However, to achieve multiple or complex patterns, multiple spray guns and nozzles must be used. As a result of the additional equipment, and the increase in workers and maintenance necessitated by the additional equipment, the cost of achieving multiple or complex spray patterns increases significantly.

In addition to higher cost, it is sometimes difficult to conduct certain spraying operations within the confines of a given narrow space. Particularly in continuous spray coating operations, a reflected layer of coating particles may form on the surface of the coated object and collide with subsequent coating particles, causing additional collisions, dispersion of the coating material and inefficient coverage of parts. This problem is particularly acute where the part to be coated is concave, such as the interior of a can. In addition to the inefficiency of the spray coating processes caused by the reflected coating particles, the collision and dispersion of the reflected particles pollutes the spraying environment and becomes a source of contamination. More particularly, some portion of the reflected spray invariably lands on and accumulates on the end of the nozzle, thereby further inhibiting uniformity and consistency in the spray coating of materials.

It is an object of the invention to provide a method and apparatus for dispensing liquid in multiple and/or complex patterns in an economically feasible manner, within a minimum space, in a manner which minimizes deflection and/or turbulence of atomized particles during dispensing, and in a manner which minimizes the adverse effects of accumulation of reflected spray on the nozzle end of the dispensing equipment.

SUMMARY OF THE INVENTION

To these ends, this invention contemplates a liquid or powder dispensing apparatus and method that utilizes a nozzle with a central dispensing orifice and a plurality of blowout ports surrounding the orifice, with each blowout port being independently actuatable to direct a flow into contact with the dispensed liquid or powder stream. By controlling the sequence and duration of the independently actuatable flows during dispensing, a desired distribution pattern may be produced on a substrate. The invention applies to a dispensed stream in the form of a liquid with relatively large drops or an atomized spray, or powder coating.

According to one embodiment of the invention, six blowout ports are spaced equidistant around the central liquid dispensing orifice in the nozzle. The blowout ports are directed inwardly toward an axis aligned along the central liquid dispensing orifice. By sequentially actuating each of the blowout ports around the dispensing orifice during liquid dispensing, the dispensed stream is sequentially deflected in six different directions to form a generally circular deflecting pattern on a substrate. Alternately, two or more of the blowout ports could be actuated simultaneously to create further variations in deflection.

One particular advantage provided by this inventive method and apparatus relates to coating of the entire interior surface of a metal can with a single nozzle. Due to increased versatility and control of the direction of the stream that is dispensed from the orifice of the nozzle, the inside surface of a can may be uniformly coated at a reduced cost, and with a minimum of undesired air cushioning.

Air cushioning is reduced by sequentially actuating the blowout ports located around the dispensing opening to supply radially inwardly directed flows from directions which rotate circumferentially around the stream. Rotational deflection of the stream prevents undesired reflection and dispersion of the stream. As a result, a problem of prior coating methods, that of uneven coating in the corners of the can, is eliminated. These benefits are also achieved when the dispensing apparatus of this invention is used to coat the inside surface of a can by spray coating with a powder stream or by spraying a liquid stream.

According to a first preferred embodiment of the invention, this dispensing apparatus includes a dispensing gun with a timer actuated solenoid valve that controls dispensing flow from an inner chamber and out of an orifice in a nozzle connected to the end of the gun. The nozzle also includes six radially directed bores which communicate with six respective blowout ports, each blowout port aimed to intersect the stream from the nozzle orifice at a slight distance away from the tip of the gun. Six conduits connect to the radial bores and supply compressed gas to the blowout ports. The flow of pressurized gas through the conduits, the bores and out of the blowout ports is controlled by electrically actuated solenoid valves connected to the conduits. The solenoid valves are actuated by the timer which also controls the flow valve of the gun. The timer is preferably a pulse controller capable of supplying current pulses ranging from about 4 milliseconds to 50 milliseconds.

By controlling the timing sequence and duration of the current pulses from the timer to the dispensing valve and to the valves which control the flow of blowout gas from the blowout ports, the dispensing stream may be deflected in a desired manner to achieve a complex distribution pattern on a substrate.

The central dispensing orifice may be a single orifice at the end of a passage that extends to a liquid or powder reservoir. The nozzle and gun may also be equipped for an airless spray nozzle. Alternately, the nozzle may also include a concentric atomizing port located immediately between the nozzle opening and the blowout ports for binary liquid spray dispensing. These latter two embodiments enable controlled deflection of a stream of particles that have already been atomized. The gun and nozzle may also be adaptable for extruding a liquid.

According to additional preferred embodiments of the invention, the nozzle opening may include two or more orifices for liquid dispensing of two or more types of liquid. The multiple orifices may be arranged side-by-side, or concentrically. One of the orifices may be used to mix aerosol into another dispensing liquid. Additionally, aerosol may be used as the deflecting agent through the blowout ports for deflecting the mixture.

Because the coating stream may be deflected in a varied number of directions, this invention promotes increased spraying or dispensing versatility from a single nozzle within a minimum amount of space. This invention also reduces the cost spraying multiple or complex patterns because a single nozzle can be used to achieve a wide range of distribution patterns. If desired, additional blowout ports may be provided to further increase versatility in achieving complex deflection patterns.

For each of these preferred embodiments, the invention further contemplates structure for minimizing the adverse effects of accumulation of reflected liquid at the nozzle end. Namely, a rotatable masking plate mounted to the end of the nozzle has an opening aligned with the nozzle hole. The masking plate blocks the blowout ports from reflected liquid, thereby preventing accumulation of liquid at or near the blowout ports. High pressure air supplied to the space between the plate and the nozzle prevents reflected material from accumulating on the nozzle. Additionally, rotation of the masking plate removes reflected liquid accumulated thereon, by certrifugal force. For coating materials with high adhesion properties, one or more fixedly mounted cleaning solution nozzles direct cleaning solution against the entire external surface of the plate during rotation to keep it clean. Additionally, a cover located outside the cleaning nozzles prevents the cleaning solution from contacting the object to be coated or contaminating the coating atmosphere.

These and other features of the invention will be more readily understood in view of the following detailed description of the drawings.

BRIEF DESCRIPTION OF THE DRAWINGS

FIG. 18 depicts a uniform spray pattern particularly suitable for coating the inner surface of a metallic can.

FIGS. 19A and 19B show alternate methods of uniformly coating the inside surface of a metallic can according to the invention.

DETAILED DESCRIPTION OF THE INVENTION

Figures 1, 2, 3:
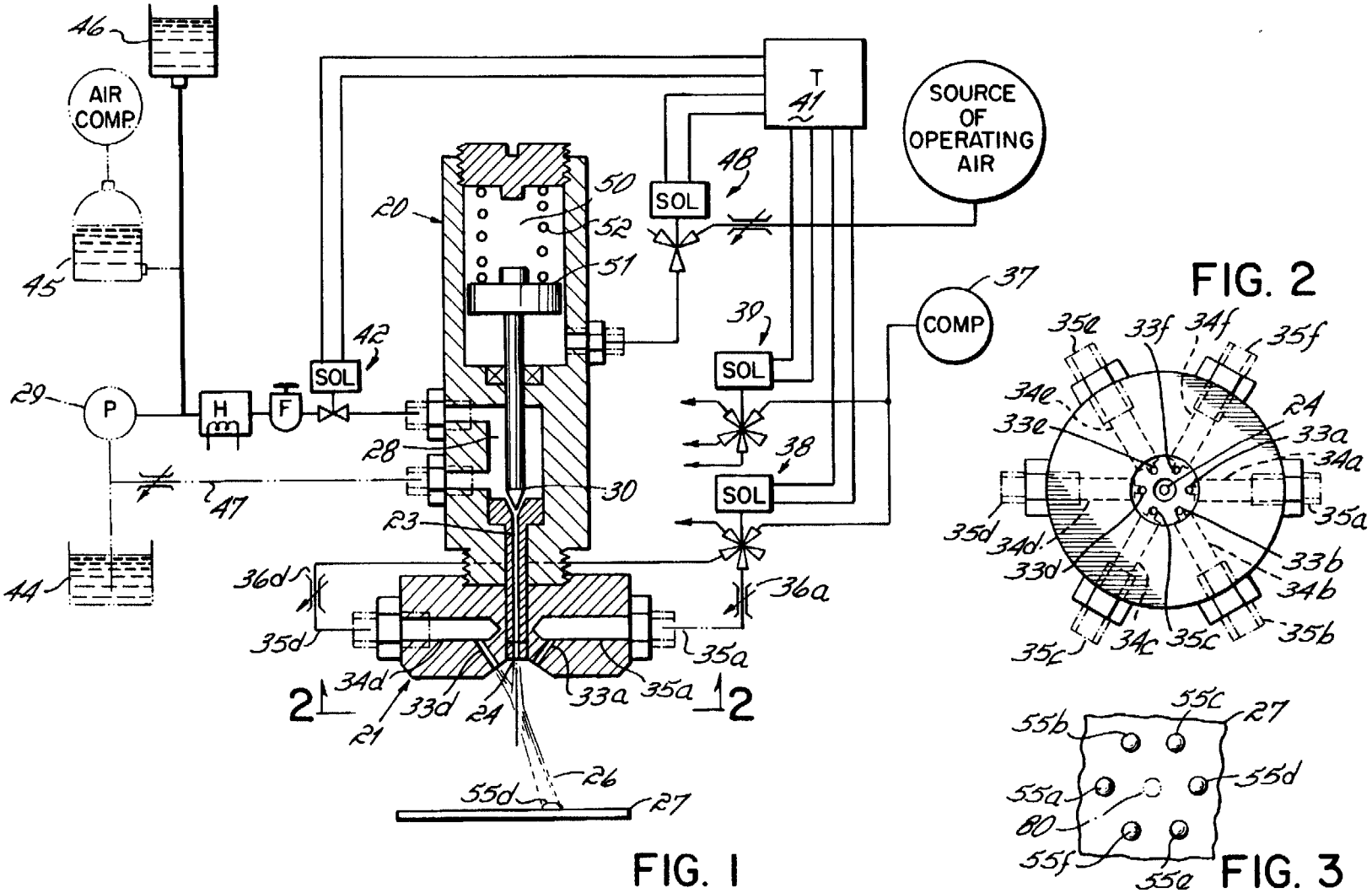
FIG. 1 is a cross-sectional schematic view of a liquid dispensing apparatus in accordance with a first preferred embodiment of the invention.
FIG. 2 is a view taken along lines 2—2 of FIG. 1.
FIG. 3 shows a dot pattern formed on a substrate by the apparatus depicted in FIG. 1.

FIG. 1 shows a liquid dispensing apparatus, or gun, designated generally by numeral 20, according to a first preferred embodiment of the invention. The gun 20 is connected to a nozzle 21 for dispensing of a liquid therefrom. The aligned gun 20 and nozzle 21 form a central liquid passage 23 which terminates in an orifice 24 through which liquid is dispensed. While this invention contemplates liquid dispensing as drops, droplets or atomized particles in a spray, or the dispensing of powder for powder coating, the dispensed material is generally referred to in the application as a stream, and designated by numeral 26. The surface upon which the stream 26 is dispensed and distributed is referred to generally as substrate 27.

The dispensing liquid is contained within the gun 20 inside an annular chamber 28. Fluid supplied to the chamber 28 is provided by an external pump 29 connected to the gun 20. Flow control of dispensing liquid from chamber 28 is accomplished by operation of a liquid valve 30 which extends through chamber 28 and seats within an upper end of central liquid passage 23.

Nozzle 21 includes six blowout ports, designated consecutively by numerals **33*a*–33*f*. Gas blown from the blowout ports deflect the dispensed liquid stream 26 to provide a desired deflection distribution on substrate 27. While six blowout ports 33*a*–33*f* are shown, it is contemplated that an optimal arrangement would include up to thirty-six blow out ports. Each blowout port communicates with a respective, radially directed bore in the nozzle 21, designated consecutively by numerals 34*a*–34*f* and shown in phantom in FIG. 2. Six conduits designated consecutively by numerals 35*a*–35*f* connect to the outer circumference of the nozzle 21 for fluid communication with radial bores 34*a*–34*f*, respectively. Valves 36*a*–36*f* are located along conduits 35*a*–35*f*, respectively. Valves 36*a*–36*f* are located along conduits 35*a*–35*f*, respectively, although only valves 36*a* and 36*d* are shown in FIG. 1. The valves 36*a*–36*f* regulate the flow of pressurized gas toward blowout ports 33*a*–33*f*, respectively. At least two solenoid valves 38 and 39 are operatively connected to the conduits 35*a*–35*f*, through the bores 34*a*–34*f* and eventually out of the blowout ports 33*a*–33*f*. Solenoid valves 38 and 39 are electrically connected to a timer 41, and, as depicted, each of these valves 38 and 39 control gas flows from three of the blowout ports. If additional blowout ports are used, additional solenoid valves may be necessary. The timer 41 actuates the solenoid valves 38 and 39 according to a desired sequence and duration to produce a predetermined distribution pattern of the liquid stream 26 onto the substrate 27**.

Preferably, the timer 41 is a current pulse controller capable of providing square wave current pulses of selectable durations. Particularly in spray coating application, since disturbances referred to as air cushions may cause undesired reflection of the gas flows, as described in the background, it is best if the time duration of the current pulses from timer 41 are kept under 500 milliseconds. Preferably, the timer 41 should be capable of delivering current pulses ranging in duration of several milliseconds, i.e. about 4 milliseconds, up to about 50 milliseconds.

The timer 41 is also electrically connected to a solenoid value 42 which controls the supplying of liquid from pump 29 to chamber 28. Dispensing liquid may be supplied from a liquid tank 44, a pressurized liquid tank 45 or a gravity pressure tank 46. A feedback line 47 may also be used to connect chamber 28 with pump 29 to assist regulation of pressure and/or flow conditions of dispensing liquid in chamber 28. With the liquid in chamber 28 pressurized by pump 29 and the peripherally connected components, raising of valve 30 from its seated position within passage 23 causes pressurized liquid in the chamber 28 to flow along passage 23 and out of orifice 24. To raise valve 30, the timer 42 electrically actuates a solenoid valve 48 to permit pressurized gas flow into a cylinder 50 at the top of the gun 20. The pressurized gas moves a piston 51 upwardly within the cylinder 50 to raise the valve 30. When no pressurized gas is supplied from solenoid valve 48, downward force from a spring 52 acts against the top surface of the piston 51 to hold valve 30 in a normally closed position. A valve 49 may be used to variably control the volume of gas that flows into cylinder 50 when solenoid valve 48 is actuated.

FIG. 2 shows the radial orientation of the six blowout ports **33*a*–33*f* with respect to orifice 24. From this view, it can be readily seen that the alignment of the blowout ports 33*a*–33*f* enables a liquid stream 26 to be deflected from the opening 24 in any one or six radial directions, the six directions being spaced 60° around the exterior of the orifice 24**.

FIG. 3 shows a dot pattern formed on a substrate 27 using the gun 20 depicted in FIG. 1. When valve 30 is raised to an "open" position, the liquid in chamber 28 moves through passage 23 and out orifice 24 in a downward direction. If the liquid has a relatively low pressure in contrast to a relatively high viscosity, a high cohesive force is created. For instance, a rubber type substance or a hot-melt adhesive agent would fit this description and produce a high cohesive force. As a result, the effluent flow will create a linear form of discharge flow. Compressed gas is then blown out sequentially from each of the multiple, independently actuatable gas blowout ports **33*a*–33*f*. As the gas blowout flows strike the linear outgoing flow, the liquid stream 26** is deflected, or redirected in a different direction.

As shown in FIG. 3, when liquid with a high cohesive force is deflected from a downward linear direction, a dot pattern is achieved, the size and spacing of the dots depending upon the blowout pressure of the distribution gas. FIG. 3 shows dots **55*a*–55*f* produced by gas flows from blowout ports 33*a*–33*f***, respectively. It is noted that each dot resides on the opposite side of the blowout port from which it was deflected.

Figure 4:
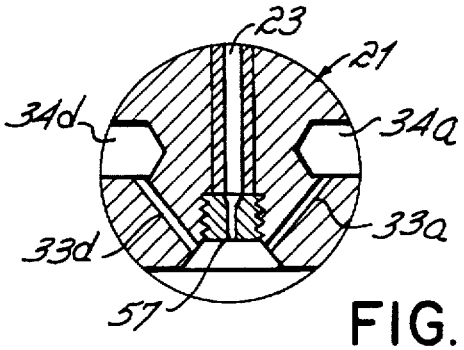
FIG. 4 is an enlarged, cross-sectional schematic showing the liquid dispensing apparatus of FIG. 1 equipped with an airless spray nozzle in accordance with a second preferred embodiment of the invention.
Figure 5:
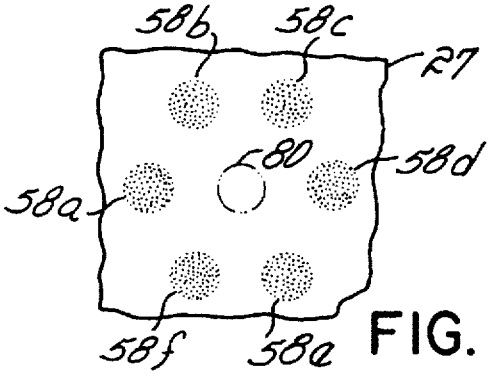
FIG. 5 shows a spray pattern formed on a substrate by the apparatus depicted in FIG. 4.

FIG. 4 shows an enlarged view of a nozzle 21 suitable for use in gun 20 in accordance with a second preferred embodiment of the invention. According to this embodiment, the nozzle 21 is equipped with an airless spray orifice 57, which makes it possible to obtain a complex spray pattern from a liquid stream 26 that is atomized. All of the other elements of the gun 20 are similar to those shown in FIG. 1, although higher liquid pressures may be necessary. The liquid used to produce the dot pattern of FIG. 3 had a relatively high viscosity, but the liquid used with airless spray orifice 57 has a relatively low viscosity (for instance a solvent, coating agent, emulsion, oil, atomized gas, etc.). Because the liquid stream 26 is atomized during discharge, the resulting pattern which appears on substrate 27 is a spray coating pattern, as shown in FIG. 5. Instead of the dots 55*a*–55*f* of FIG. 3, the airless spray orifice 57 produces spray regions 58*a*–58*f* of atomized droplets corresponding to directional gas flows from the blowout ports 33*a*–33*f*, respectively.

Figure 6:
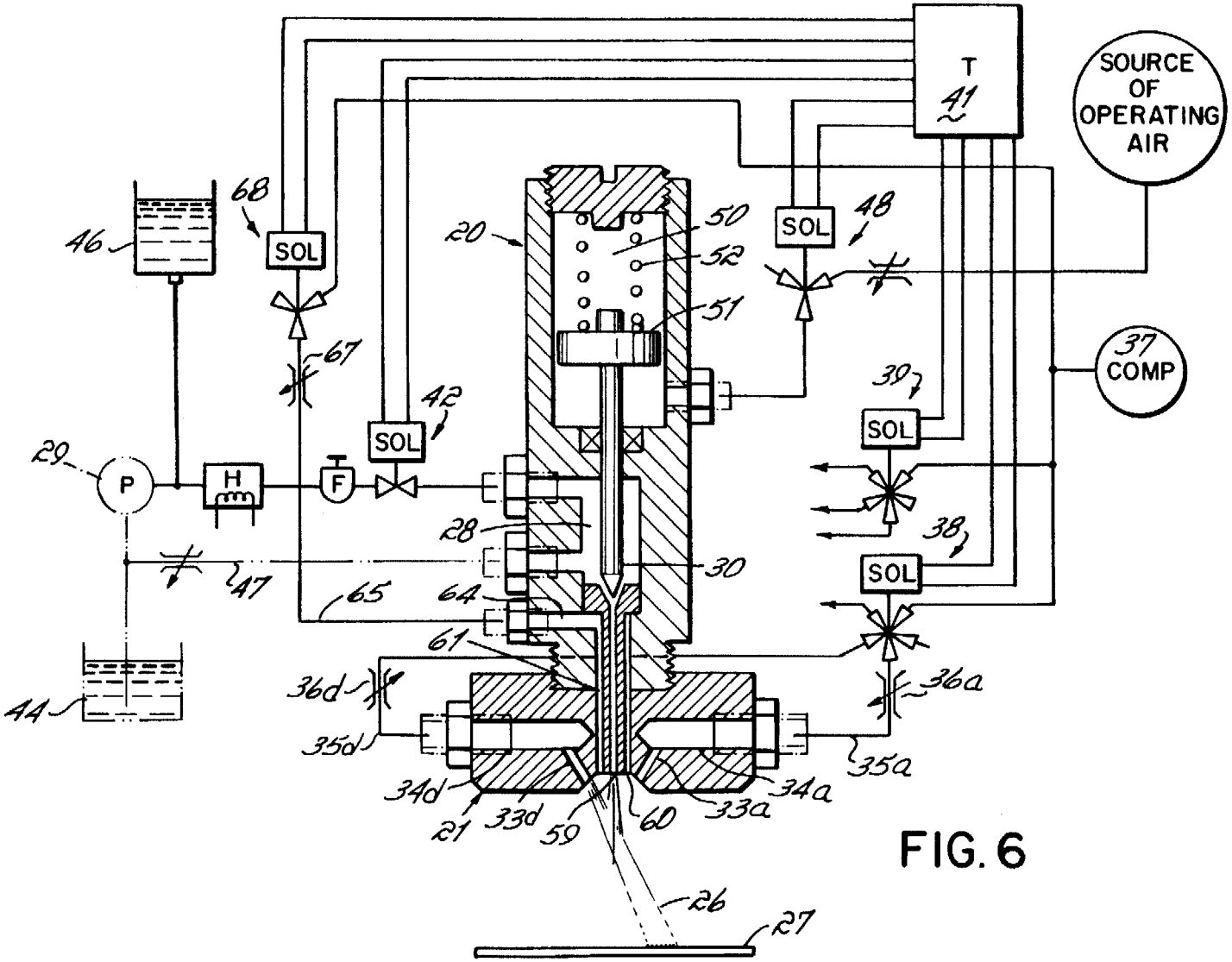
FIG. 6 is a cross-sectional schematic view similar to FIG. 1, but with the liquid dispensing apparatus modified to incorporate a nozzle equipped for binary liquid spray dispensing in accordance with a third preferred embodiment of the invention.

FIG. 6 shows a third preferred embodiment of the invention, which contemplates use of a gun 20 equipped to provide binary liquid spray to achieve atomization of the liquid stream 26. According to this embodiment of the invention, the gas blowout ports 33*a*–33*f* surround the periphery of a nozzle orifice 59 and atomization of the dispensed liquid is achieved by discharging atomizing gas from the nozzle 21 via a concentric atomizing gas outlet 50 located at an end of the longitudinal, concentric passage 61. The atomization creates a spray flow for the liquid stream 26. Similar to the first and second embodiments described above, the atomized liquid stream 26 combines with multiple distribution as blowout flows from the blowout ports 33*a*–33*f*. When the gas blowout ports 33*a*–33*f* are actuated sequentially to produce gas flows which strike the atomized liquid stream 26, deflection occurs and it is possible to obtain a desired complex pattern as shown in FIG. 5.

The binary liquid spray gun 20 of FIG. 6 is similar to that of FIG. 1, except for the modifications necessary to spray atomizing air along passage 61 from outlet 50 into the liquid stream 26. More particularly, the gun 20 includes the passage 61 which terminates in a bore 64, and the bore 64 is connected to a conduit 65 which is in turn connected to the pressurized source 37 via a solenoid valve 68. Solenoid valve 68 is electrically actuated by timer 41 to permit pressurized air flow along conduit 65, through bore 64, along passage 61, and eventually out of outlet 60 during liquid dispensing from orifice 23, thereby to atomize the liquid stream 26. An additional flow valve 67 may be used along conduit 65 to provide additional control over the flow of atomizing gas therethrough.

Figure 7A:
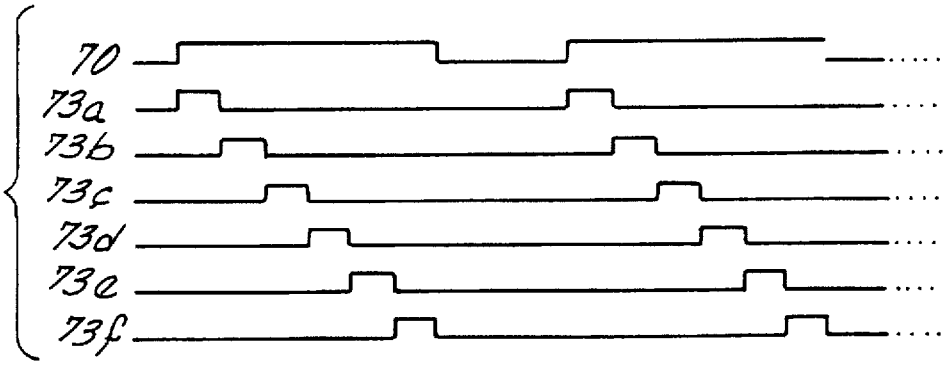
FIG. 7A is a timing diagram for operation of the apparatus shown in FIG. 1. The timing diagram depicts current pulses that control liquid dispensing from the nozzle and gas flows from the blow out ports.

FIG. 7A depicts current versus time for the current signals from timer 41 which control operation of the liquid dispensing valve 30 and gas flows from the blowout ports 33*a*–33*f*. Curve 70 represents the timing of the discharge of the liquid from orifice 24. When a signal is received from the timer 41 or pulse controller 41 in FIG. 1, the operational position of the solenoid valve 48 will be the "open" position, and the operating air will be connected directly to the gun 20 so that it will penetrate inside the air cylinder 50 to raise piston 51 and valve 30 to discharge the liquid.

Numerals 73*a*–73*f* represent the current pulses that generate the gas flows from respective multiple distribution gas blowout ports 33*a*–33*f*. When the distribution blowout ports (six in this case) have identical allocations for liquid discharge time, sequentially distributed gas is blown out from each of the blowout ports 33*a*–33*f* during only one allocated time pulse. FIG. 7A shows blowout from the first blowout port 33*a* occurring simultaneously with the pulse 70 which initiates discharge of the liquid stream 26. Subsequently, the other blowout ports 33*b*, 33*c*, 33*d*, 33*e* and 33*f* are actuated sequentially by respective pulses 73*b*, 73*c*, 73*d*, 73*e* and 73*f*. When a gas flow from a blowout port strikes the liquid stream 26, the two flows combine to create a deflected directional flow that eventually lands on the surface of the substrate 27.

Figure 7B:
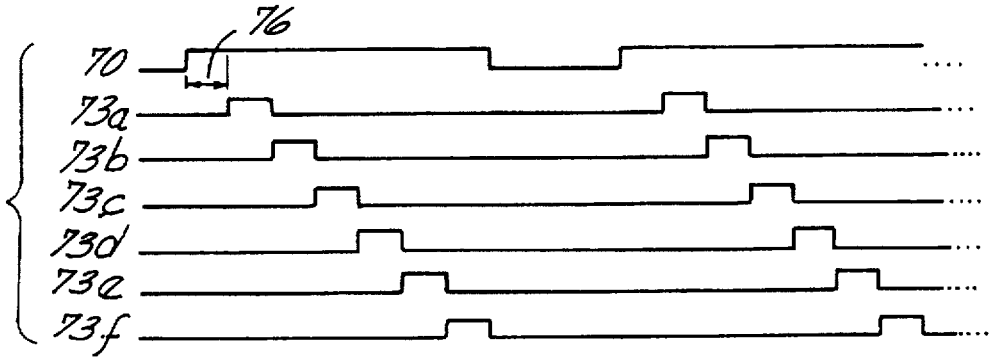
FIG. 7B shows an alternate timing diagram for controlling liquid dispensing and gas flows from the blow out ports.

With six distribution gas blowout ports, six liquid agglomerates can be gradually distributed into respective locations, sequentially and one by one. According to the timing of the liquid signal 70 and the pulses 73*a*–73*f* shown in FIG. 7A, the substrate 27 will be coated according to the following sequence of coating regions 74*a*, 74*b*, 74*c*, 74*d*, 74*e* and 74*f*. If the timing is modified, the sequence will be altered. Furthermore, if necessary, when the gas flow is interrupted, the liquid stream 26 will flow vertically downward and form a central region 80 residing within the center of the six regions 74*a*–74*f* on the substrate 27. FIG. 7B depicts a timing diagram in which the first gas flow commences a time delay 76 later than initial discharge of the liquid stream 26.

Figure 8A:
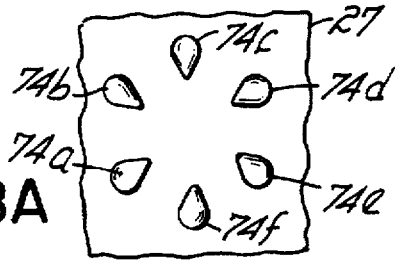
FIG. 8A and 8B depict spray patterns formed by the apparatus shown in FIG. 1 when operated according to the timing diagram of FIGS. 7A and 7B, respectively.
Figure 8B:
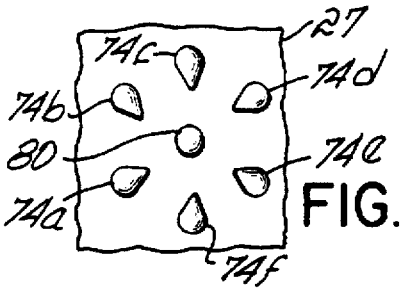

FIGS. 7A and 7B show timing for continuously discharged liquid with sequentially blown out gas. With continuous liquid dispensing, some of the direction of the liquid stream 26 will be retained during distribution as it existed before the change of the direction. More particularly, a tail, such as those shown in FIG. 8A and 8B will be added to each of the dot shapes or coated regions 74*a*–74*f*. Note that central dot 80 remains unaffected in FIG. 8B.

Figure 9:
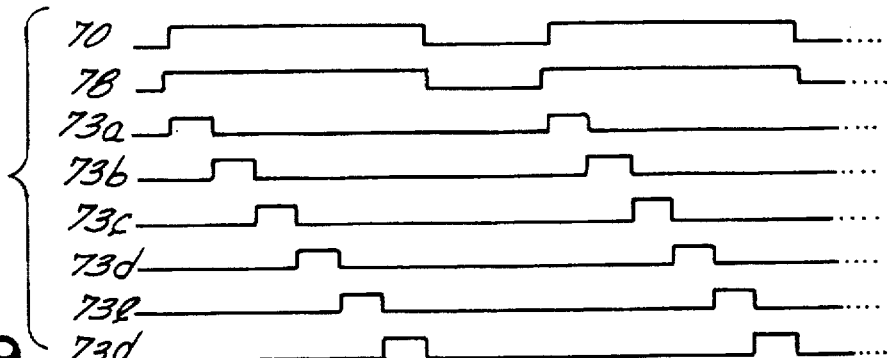
FIG. 9 shows a timing diagram for controlling liquid dispensing and the gas flows from blowout ports for the binary liquid gas dispenser shown in FIG. 6.
Figure 10A:
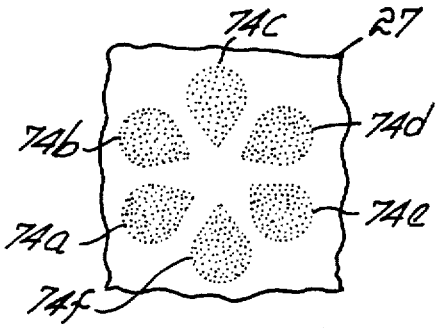
FIG. 10A depicts a spray pattern formed by the apparatus shown in FIG. 6 when operated according to the timing diagram of FIG. 9.
Figure 10B:
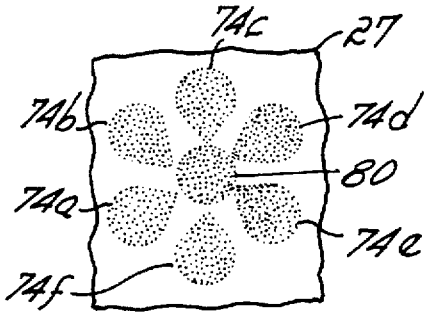
FIG. 10B depicts a spray pattern formed by the apparatus shown in FIG. 6, but with the timing diagram of FIG. 9 slightly varied to include a delay before the initial gas flow from the blowout ports.

FIG. 9 shows an example of the coordination of the current pulses 70, 78 and 73*a*–73*f* for producing discharge of liquid, atomized gas and distributed gas flows, respectively, using the binary liquid spray gun 20 shown in FIG. 5. The timing pulses of FIG. 9 produce distribution of the liquid stream 26 on a substrate 27 in the pattern shown in FIG. 10A. If a time lag between signal 70 and signal 73*a* were to be used, all of the other gas flows were sequenced and of the same duration, the pattern shown in FIG. 10B would be produced on substrate 27.

Figure 11A:
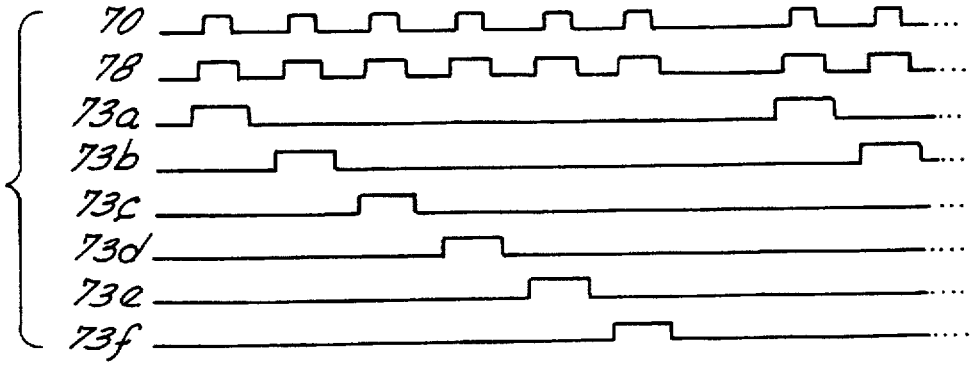
FIGS. 11A and 11B depict timing diagrams for operating the liquid dispensing apparatus shown in FIG. 6.
Figures 12A, 12B, 12C, 12D:
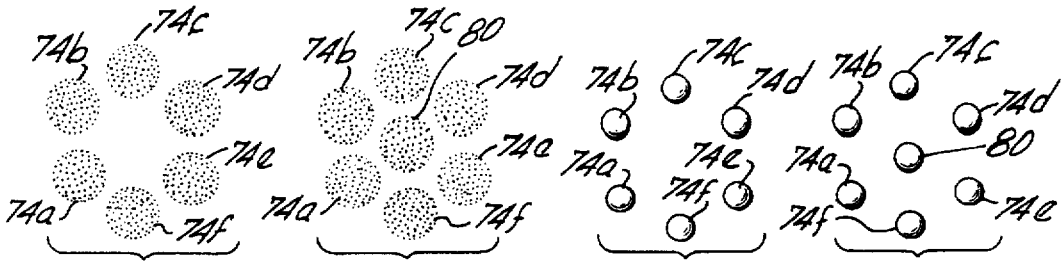
FIG. 12A depicts a spray pattern that may be formed with the liquid dispensing apparatus shown in FIG. 6, when operated according to the timing diagram of either FIG. 11A or FIG. 11B.
FIG. 12B depicts an alternate spray pattern that may be formed with the device of FIG. 6 and the timing diagram of either FIG. 11A or FIG. 11B, if a time delay is included between initial liquid dispensing and the first gas flow.
FIG. 12C shows dot patterns that may be formed with the device of FIG. 1 if liquid dispensing occurs intermittently.
FIG. 12D is similar to FIG. 12C, but includes a time delay between initial dispensing and the first gas flow.
Figure 11B:
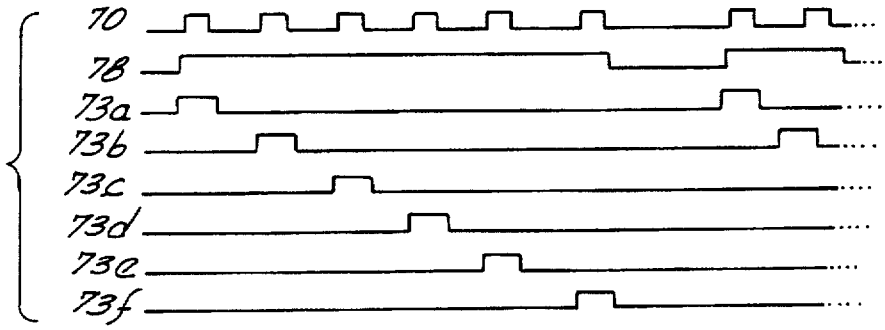

FIG. 11A depicts current pulses which produce intermittent discharge of liquid stream 26 and intermittent actuation of atomized gas. FIG. 11B depicts current pulses which produce intermittent discharge of the liquid stream 26 with continuous blowing out of atomized gas. In both of these cases, when the intermittent liquid stream 26 strikes the gas from the ports 33*a*–33*f*, the direction of the flow during the previous change of each of the spray flows is not maintained. In other words, since there is a discontinuation in liquid dispensing, i.e. signal 70, the spray distribution patterns of FIGS. 12A and 12B are produced without tails. Again, FIG. 12B depicts a central coated region 80 that would be caused if the first gas flow were to lag behind initial liquid dispensing. This current control scheme is not depicted. In both FIG. 11A and FIG. 11B the current pulses to actuate the gas flows, i.e. 73*a*–73*f*, are sequenced and staggered.

Although the above examples relate to an atomized liquid stream 26, it is also possible to use current pulses to intermittently actuate the liquid stream 26 produced by the device of FIG. 1 for the purpose of obtaining dot shaped patterns, as shown in FIGS. 12C and 12D. Note that FIG. 12D depicts a pattern that would be formed if time lag were used between initiation of liquid dispensing and first gas flow from the blowout ports. In all cases, if the liquid dispensing is intermittent, the spray pattern will not have tails.

Figures 13A, 13B, 13C, 13D:
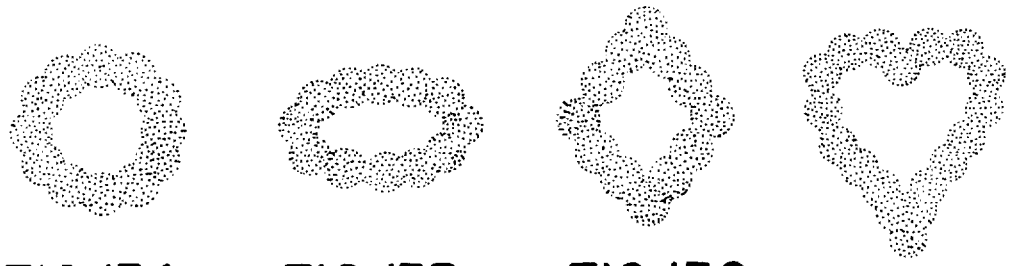
FIGS. 13A, 13B, 13C and 13D depict additional, complex spray patterns that may be formed by the liquid dispensing apparatus of FIG. 6 if equipped with a nozzle having additional blowout ports and, with respect to FIG. 13B, FIG. 13C and FIG. 13D, additional blowout ports and either varied angles of directional gas flow or variation in volume of gas flows.

Although the explanation above describes six distribution gas blowout ports 33*a*–33*f* and the patterns have a generally circular shape, the number of these distribution gas blowout ports may be increased to twelve to obtain a ring shape, such as the one shown in FIG. 13A. This example and prior examples all used identical blowout pressures and blowout times. However, if these variables are changed, it becomes possible to obtain more complex patterns, such as those shown in FIGS. 13B, 13C and 13D. For instance, the patterns shown in FIGS. 13B and 13C require a total of twelve ports, similar to FIG. 13A, but with some of the ports angled differently than the others. Alternately, the same designs could also be achieved if the durations of the current pulses were varied to change the volumes of the gas flows contacting the liquid stream 26. The pattern of FIG. 13D requires six blowout ports and variation in the angles of the ports, or alternately, variation in the duration of the current pulses which generate the gas flows. While FIGS. 13A–13D show the effects of variation in blowout ports angles and/or current pulse duration for the spray, the same techniques can also be applied to the apparatus shown in FIG. 1 to obtain dot shaped patterns.

While use of the blowout ports to achieve single directional deflection has been described, it is also possible to use a combination of intersecting gas flows. It is also possible to use gas flows to create a twist to the liquid stream 26. Such a technique is a particularly different method of applying dot shapes in a desired distribution pattern.

Figures 14A, 14B, 14C:
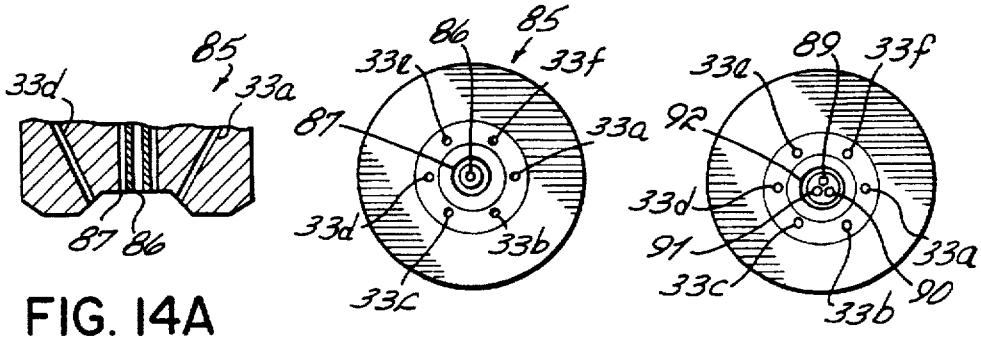
FIG. 14A is a cross-sectional view of an airless spray nozzle for multiple liquid, mixed sprays.
FIG. 14B is a bottom view, looking upwardly, of the airless spray nozzle stream in FIG. 14A.
FIG. 14C is a bottom view, similar to FIG. 14B, of a binary liquid spray nozzle for multiple liquid, mixed sprays.

According to another embodiment of the invention, multiple liquids may be discharged from multiple nozzles, as shown in FIGS. 14A, 14B and 14C. By mixing the discharged liquids, a combined flow is achieved. This would enable the addition of a hardening agent or similar agent for mixing in advance, so that the dispensed liquid would harden more readily. FIGS. 14A and 14B show an airless spray nozzle 85 for mixing liquids dispensed from an inner orifice 85 and an outer, concentric orifice 87. Both orifice 85 and 87 reside within the blowout ports 33*a*–33*f*. FIG. 14C shows a variation for spraying a liquid stream 26 of liquid from three orifices 89, 90 and 91, located within a concentric atomizing outlet 92, with blowout ports 33*a*–33*f* located further outside.

Figure 15:
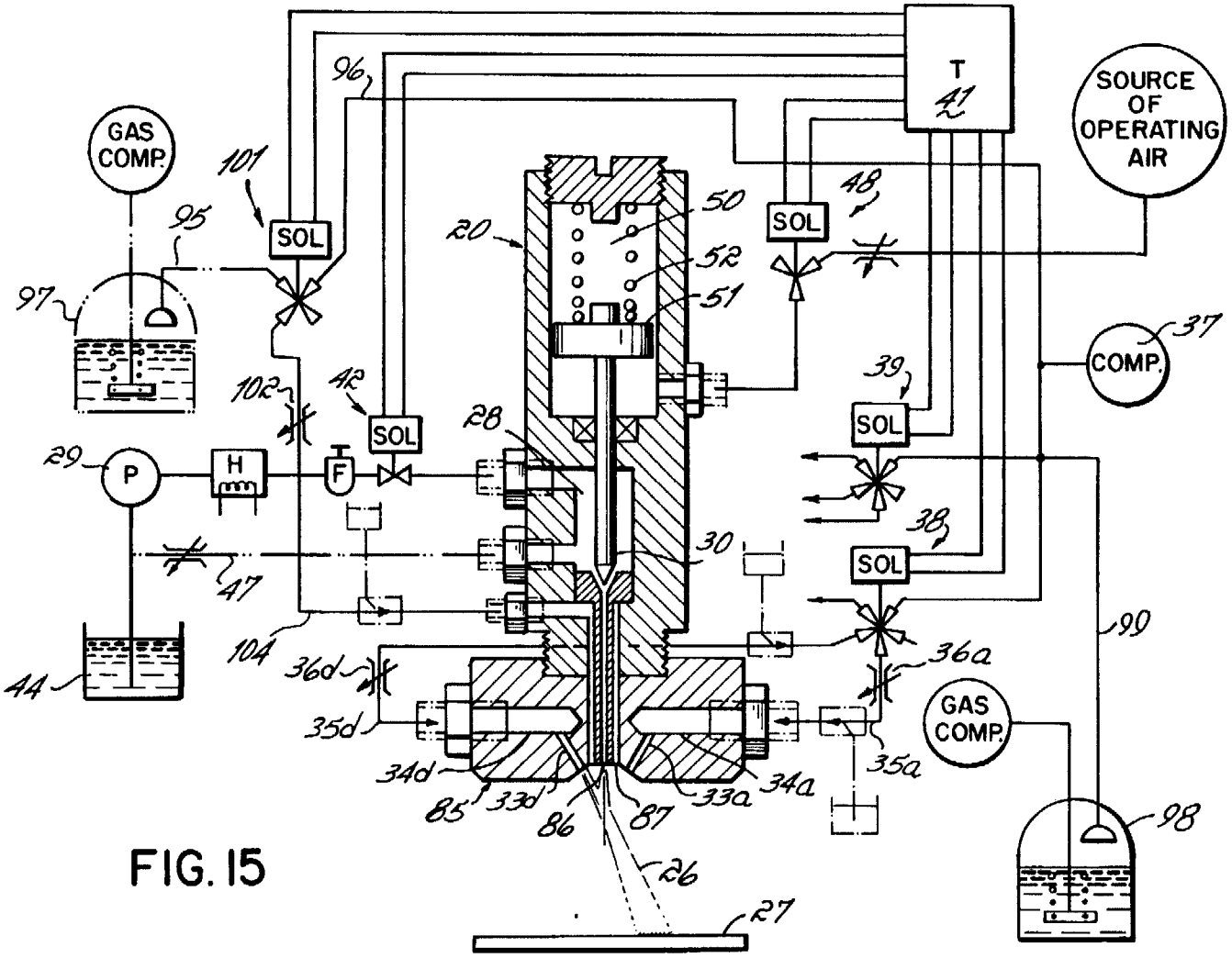
FIG. 15 is a cross-sectional view of a liquid dispensing apparatus which mixes aerosol with another dispensing liquid and deflects the mixture with aerosol, according to a fourth preferred embodiment of the invention.

One of the additionally mixed liquids may also be liquid aerosol, as shown in FIG. 15, with aerosol supplied by one, or both, or the conduits 95 or 96 connected to tanks 98 and 98, respectively. Flow of liquid aerosol to orifice 87 of the gun 20 via line 104 is controlled by a solenoid valve 101 connected to timer 41. Valve 102 provides additional control of aerosol flow through line 104.

FIG. 15 also shows that aerosol conduits 96 and 99 from tanks 97 and 98, respectively, interconnect to solenoid valves 38 and 39. Thus, according to this invention, the aerosol is supplied to the blowout ports 33*a*–33*f* and used as the blowing agent to deflect the mixed liquid stream 26 formed from both liquids dispensed out of nozzle 21. It would also be possible to supply different aerosols to each of the blowout ports 33*a*–33*f*, provided that additional pipe lines were used for each of the aerosols.

Mixing of the liquid that forms the aerosol can be conducted with a solvent, a catalyst, a hardening agent, a liquified gas, etc. When a solvent is used, it is more effective to use self-cleaning of the orifice 23 and of the distributed gas blowout ports 33*a*–33*f*. Furthermore, it is well known that when a catalyst and a hardening agent are used, adding amine to epoxy-type paints in an effective manner of vapor curing. Also, when liquified gas is used, the high amount of energy created by expansion during mixing of gas and liquid accelerates atomization.

It is also possible to use this invention for deflecting fine particles of ice. Recently, Taiyo Oxygen KK Co. and Mitsubishi Electronics KK Co. proposed the injection of demineralized water into liquid nitrogen to create icing particles as a method to clean wafers. Other methods of using liquid nitrogen to create icing structures of liquid were described by The University of Gumma and other Atomization and Spray Systems). These concepts may be readily applied to this invention by deflecting a liquid stream 26 of iced particles formed by mixing demineralized water and liquid nitrogen. This mixture would preferably be atomized by injection of the demineralized water into the liquid nitrogen.

Figure 16A:
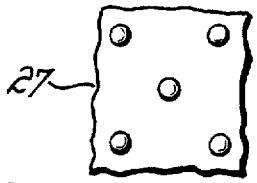
FIG. 16A and 16B show dot patterns formed with a thermoplastic resin, such as a hot melt adhesive agent, wax or a similar substance.
Figure 16B:
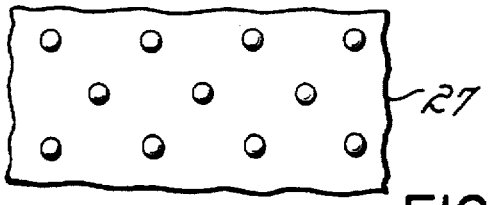
Figure 16C:
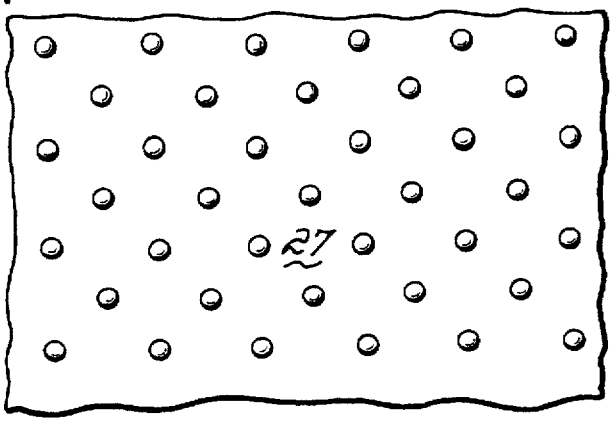
FIG. 16C shows a dot pattern similar to those of FIGS. 16A and 16B, but formed in accordance with the teachings of this invention.
Figure 17A:
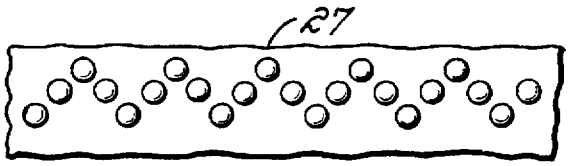
Figure 17B:
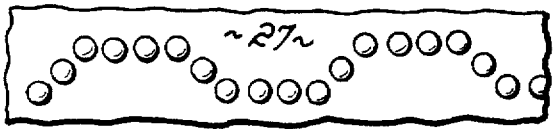
Figure 17C:
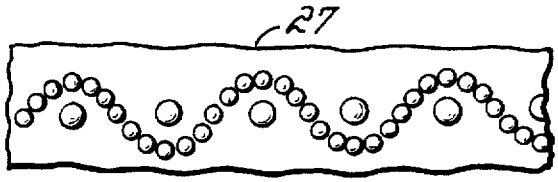
Figure 17D:
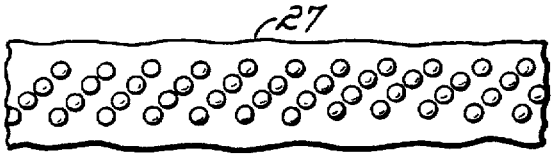
Figure 17E:
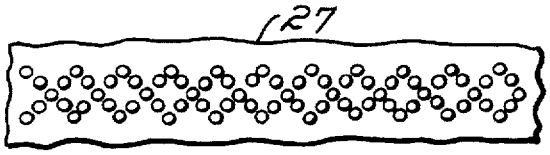

It is also to be understood that molten liquids may be used with this invention to produce a thermoplastic resin, a hot melt adhesive agent, wax, or a similar substance with relatively low viscosity under 200° C. According to prior methods for dot shaped coating of hot melt adhesives onto a substrate, the adhesive was discharged intermittently from a nozzle opening while the substrate was moved relative to the nozzle in order to achieve a straight line of coating. FIGS. 16A and 16B show distribution patterns of dots that can be attained with the gun shown in FIG. 1. FIG. 16C shows a dot distribution pattern obtainable with multiple, parallel guns 20 of this type. FIGS. 17A–17D also show distribution patterns attainable with a gun 20 of the type shown in FIG. 1, but with additional blowout ports added and liquid dispensing during relative movement of the gun 20 and substrate 27.

It is also possible to apply prior electrostatic coating methods to this invention. By charging the liquid with static electricity when the liquid is supplied to the gun, or attaching a corona pin to the vicinity of the nozzle orifice 24 for the liquid, the liquid can be charged as it is dispensed from the gun 20. Charging of the liquid stream 26 accelerates atomization, thereby reducing particle size to microscopic dimensions and improving the adhesion characteristics on a coated substrate 27.

Perhaps the most important commercial advantage of the invention relates to coating the interior surfaces of a hollow product such as a metallic container. To prevent contamination of the food contents of a can by the metal of the can, is generally necessary to coat the entire interior surface of the can in a uniform, even manner. Otherwise, the food contents in the can may lose their aroma or taste. According to one prior method of coating the interior of a can, a spray nozzle was located inside the can and the can was revolved until the entire inside circumferential surface had been coated. However, it is known that centrifugal force created by rotation of the can causes some of the spray coating to accumulate into the corners of the can, resulting in uneven coating of the inside corners of the can. Moreover, the corners of the can were particularly susceptible to spray reflection.

This invention proposes two methods for uniformly coating the inside surfaces of a can. First, adjustments are made to the timer 41 to produce a spray distribution pattern of the type shown in FIG. 18, with seven generally circularly shaped spray regions. Then, as shown in FIG. 19A, the nozzle 21 is inserted into the inside of a can 109. The liquid stream 26 is distributed by changing the direction of each of the gas flows from the blowout ports 33*a*–33*f* so that there are no reflection flows within the can 109. Because the direction of the liquid stream 26 may be shifted within a short period of time, i.e., 20 milliseconds or less, this invention eliminates the occurrence of air cushions within the can 109 during spray coating. With this method and apparatus, the time of one cycle of gas flows, i.e., one gas flow from each blowout port 33*a*–33*f*, is approximately 120 milliseconds.

With this method, it is not necessary to revolve the can 109 during coating, as required prior methods. However, even if the can is revolved, it may be revolved at a relatively low speed so that the influence of centrifugal force is relatively small. By raising the nozzle upward with respect to the fixed can 109, or lowering the can 109 with respect to the nozzle 21, coating is applied uniformly to the inner surfaces of the can 109 by a number of additional spraying cycles, with each cycle directing a coating at a predetermined position or level of the can 109. Spraying may occur while there is continuous relative movement between the gun 20 and can 109, or while the gun 20 is stationary within the can 109 at each of a finite number of different spraying positions.

According to another method of coating the inside surface of a metal can, as shown in FIG. 19B, three different coating steps or stages are used. Each stage supplies coating to a different region of the can 109, and each stage employs a gun located outside of the can but pointed toward the can. For instance, at stage 111, the nozzle 21A supplies coating to a bottom portion of can 109A, while nozzle 21B at stage 112 supplies coating to a midportion of can 109C. FIG. 19B shows coating the internal surfaces of cans 109A, 109B and 109C with three different nozzle and gun set ups, one for each coating stage. Alternately, a greater or lesser number of nozzles could be employed for greater or fewer spraying stages, particularly if the dimensions of the can 109 increase or decrease.

Figure 20:
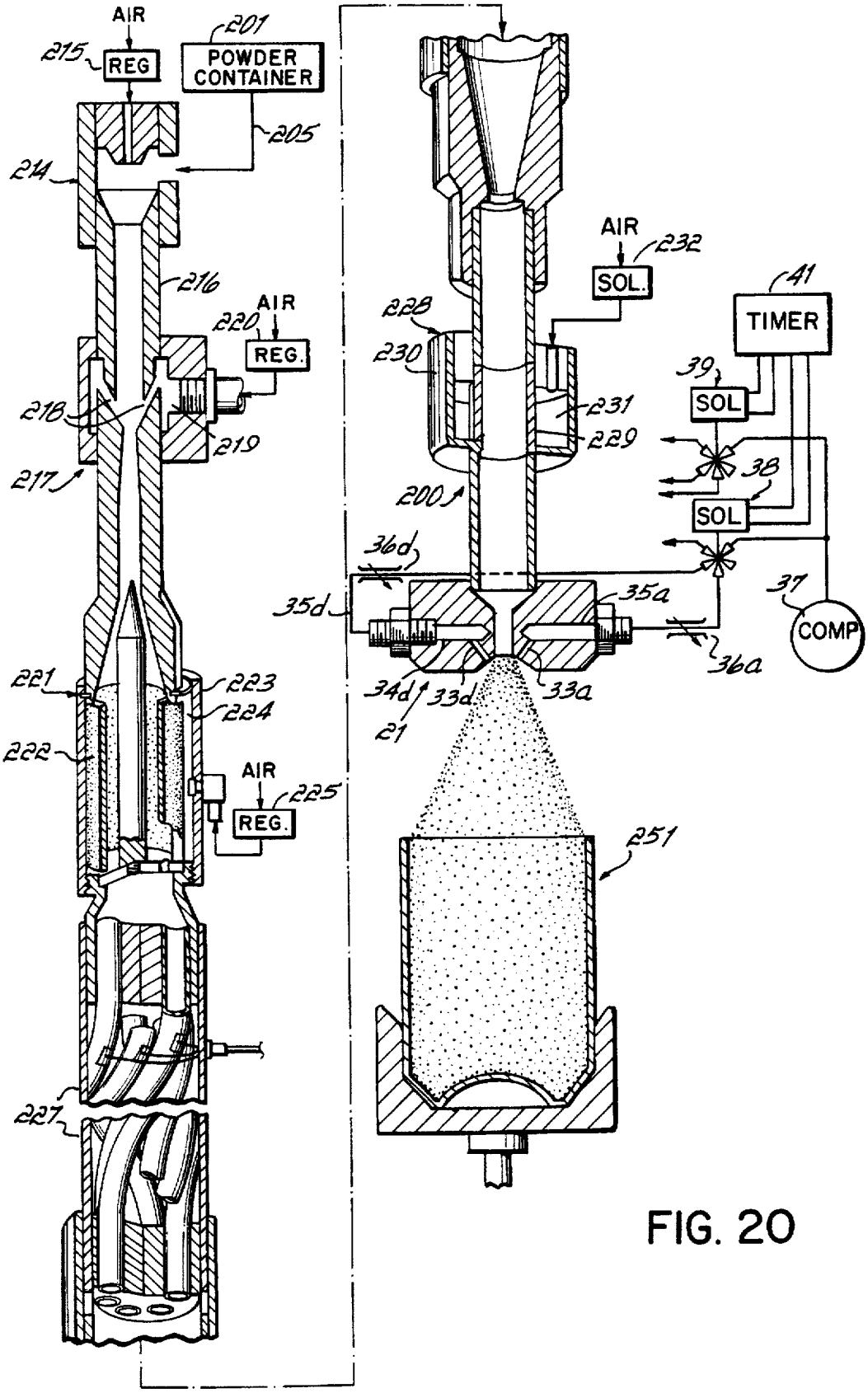
FIG. 20 is a cross-sectional schematic view which shows the dispensing apparatus of this invention equipped for powder coating, in accordance with still another embodiment of the invention, and during powder coating of the inside surface of a metallic can.

FIG. 20 shows the nozzle 21 of the dispensing gun 20 of this invention operatively supplied with powder for powder coating the inside surface of a can 250. A powder tube 200 connects directly to the nozzle 21 of the gun 20 to expel powder out of orifice 24. The powder may be generated by components of the type shown and described in FIG. 5 of applicant's U.S. Pat. No. 4,987,001, which is expressly incorporated by reference herein, in its entirety. More specifically, a fluidizing bed powder container 201 has an outlet conduit 205 which fees a powder pump 214. Air pressure from a source of air pressure (not shown) is pulsed or supplied intermittently to the pump 214 through a regulator 215 to cause powder to be suctioned from the conduit 205 out of the container 201 and propelled through a pipe 216. To further accelerate the air-entrained powder from the pump 214, an air amplifier 217 is located downstream of the pump 214.

The air amplifier 217 includes a plurality of evenly distributed ports 218 located around the interior surface of the amplifier. Each of the ports 218 is connected to air inlet passage 219, and each passage 219 is supplied from a source of air pressure (not shown) through an adjustable pressure regulator 220 so that the speed of the powder in the powder supply line can be regulated and closely controlled.

An inlet diffuser 221 located downstream from the air amplifier 217 includes a porous cylinder 222 contained internally of a surrounding, nonporous cylinder 223, with an air chamber 224 located radially therebetween. Pressure regulator 225 supplies air to chamber 224 from an air pressure source (not shown). Regulator 225 directs an evenly distributed current of air radially inwardly into the powder flow line through the porous cylinder 222.

A triboelectric charging unit 227 is located downstream of the inlet diffuser 221. This unit functions to electrostatically charge the air entrained powder contained in the powder supply line. From the tribocharging unit 227, the air entrained powder enters a second outlet diffuser 228, which is constructed similarly to the inlet diffuser 221. The outlet diffuser 228 includes an inner porous cylinder 229 encased within a solid cylinder 230, with an air chamber 231 located radially therebetween. A pressure regulator 232 supplies inlet air to the air chamber 231 from an air supply source (not shown). From the internal chamber 231 of the outlet diffuser, the air passes radially through the porous cylinder 229 into the powder supply line. There is maintained a constant stream of air from the source through the pressure regulator 232, while the inner stream to the pump 214 and the amplifier 217 is pulsed. Tube 200 conveys the powder from the outlet diffuser 228 directly to the nozzle 21. The length of tube 200 will depend upon the orientation and location of the nozzle 21 with respect to the components which generate and supply the powder.

FIG. 20 also shows the dispensing gun 20 used for powder coating the inside surface of a metallic can 250. Because of the independent control of the flow of the powder and each of the air flows out of the nozzle 21, the inside surface of the can 250 may be uniformly coated without requiring that the can 250 be rotated.

Figure 21:
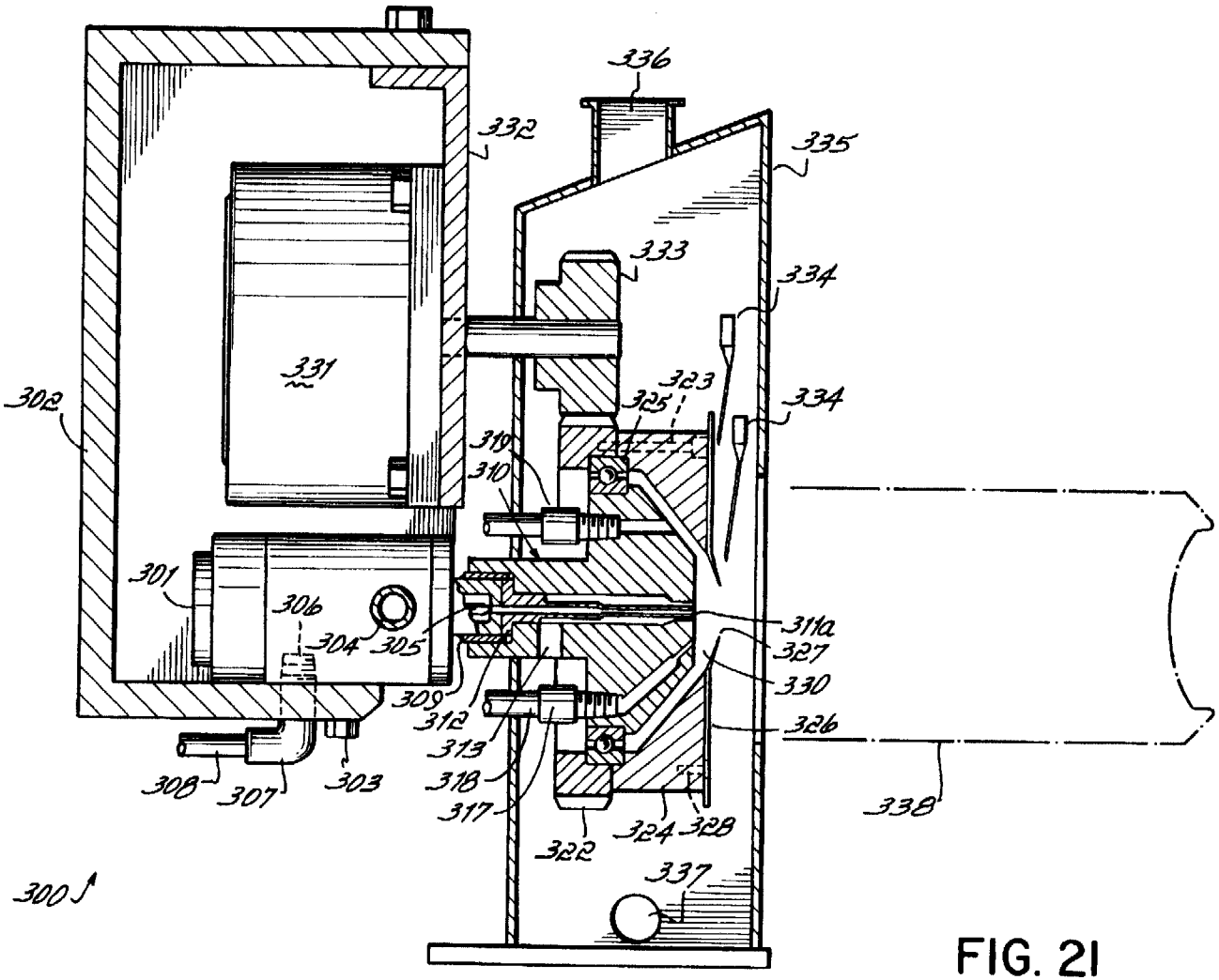
FIG. 21 is a cross-sectional view of a liquid dispensing apparatus, in accordance with the invention, and further equipped with protective structure for minimizing the adverse effects of accumulation of deflected liquid at the nozzle end.
Figure 23:
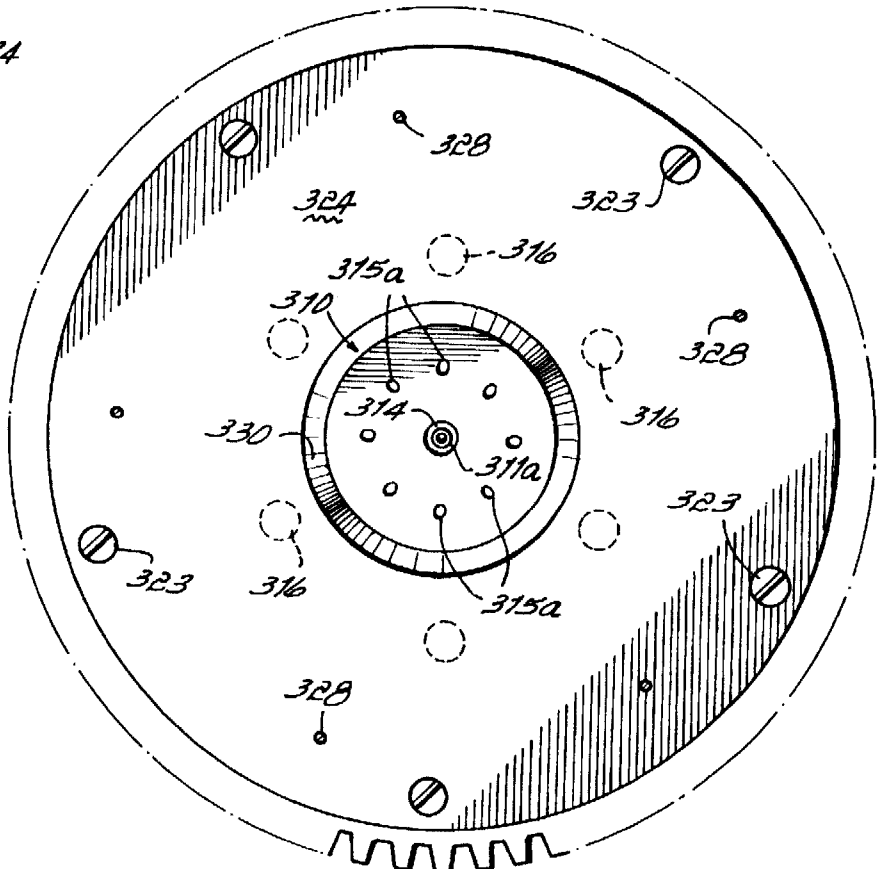
FIG. 23 is a cross-sectional view taken along lines 22–23 of FIG. 22.
Figure 22:
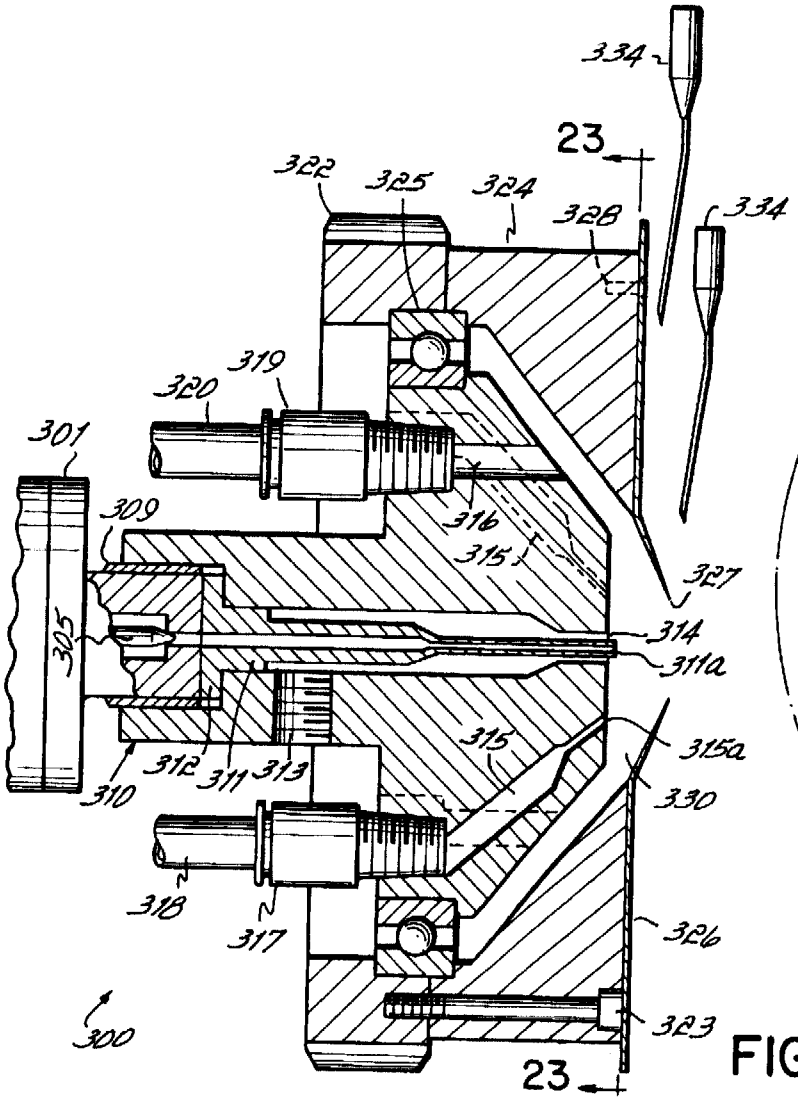
FIG. 22 is an enlarged view, similar to FIG. 21, which shows the protective structure in greater detail.

FIGS. 21, 22 and 23 show an additional feature of this invention which may be used in conjunction with any of the previously described embodiments. While these previously described embodiments significantly reduce the amount of liquid that is reflected during coating operations, there exists some need for further improvement because even small amounts of reflected liquid can accumulate at the end of the nozzle, thereby clogging the liquid passage, or one or more of the blowout ports. This clogging may have serious adverse effects on subsequent spray coating operations, either completely blocking proper flow out of the nozzle or blowout ports or impairing flow enough to cause changes in the amount of material dispensed. As a result, further coating operations lack uniformity.

While it is known to use a solvent cleaning nozzle to direct a stream of solvent against the end of a dispensing nozzle to prevent accumulation of deflected material thereon, this technology is not suitable for the present invention because it would not be possible to clean the nozzle and the blowout ports with a single cleaning nozzle, nor would it be practical to mount separate solvent cleaning nozzles for each of the blowout ports.

The apparatus 300 depicted in FIGS. 21, 22 and 23 solves these problems. More particularly, FIG. 21 shows a liquid spray gun 301 fixed to a mounting 302 by a bolt 303. The gun 301 has a liquid supply aperture 304 for introduction of coating material therethrough. The gun 301 also has an air supply aperture 306 through which high pressure air is supplied via a pipe connector 307 and an air supply hose 308. Air supplied through aperture 306 opens and closes a needle valve 305 to precisely control the spraying of material through a nozzle 311 (See FIG. 22) in accordance with a predetermined sequence. The nozzle 311 terminates at a nozzle opening **311*a***.

A flange section 312 of the nozzle 311 and a bolt section 309 hold the nozzle 311 to a deflection nozzle 310. An atomization gas introduction hole 313 is formed in the deflection nozzle 310 and supplies atomization gas to annular gas spray hole 314 located at a front end of the deflection nozzle 310 and surrounding the nozzle opening **311*a***.

The deflection nozzle 310 also includes a plurality of gas spray passages 315 which terminate at gas blowout ports **315*a*. Each gas spray passage 315 is supplied with high pressure gas via a pipe connector 317 and an air supply hose 318. The deflection nozzle 310 also has a plurality of positive pressurization passages 316 formed therethrough, each of which terminates at a front end thereof, at an angled surface which resides circumferentially outside of the nozzle opening 311***a*, the atomization spray hole 314 and the blowout ports 315*a*. Each positive pressurization passage 316 is supplied with high pressure air via a pipe connector 319 interconnected with an air supply hose 320.

A revolving wheel 322 mounts circumferentially around deflection nozzle 310, via a bearing 325. The revolving wheel 322 connects to a spacer 324 via bolts 323. A masking plate 326 connects to the spacer 324 via screws 328. Preferably, the outside diameter of the masking plate 326 is slightly larger than the outside diameter of the spacer 324. The masking plate 326 has an opening 327 formed therethrough which is aligned with the nozzle opening 311*a*. The masking plate 326 may be flat, or an inner edge thereof surrounding the opening 327 may be flared outwardly away from the deflection nozzle 310. A positive pressurization chamber 330 is formed between the front end of the deflection nozzle 310 and the masking plate 326.

A motor 331 mounts to a bracket 332 which is supported by the mounting 302. A cog wheel 333 driven by a shaft of the motor 331 engages the wheel 322 so that rotation of the cog wheel 333 will cause rotation of the wheel 322, the spacer 324 and the masking plate 326. While a cog wheel 333 is shown for rotating plate 326, it is to be understood that one of a number of other structures may be used to rotate the plate 326.

One or more cleaning solution spray nozzles 334 are mounted outside the masking plate 326 to direct cleaning solution onto the outer surface of plate 326. A cover 335 is installed around the periphery of the spray nozzles 334, the masking plate 326 and the deflection nozzle 310. The cover 335 includes an exhaust aperture 336 and a liquid discharge aperture 337. Though not shown, the spray nozzles 334 may be mounted to the cover 335, with liquid supply lines for the spray nozzles 334 routed through the exhaust apperture 336. The cover 335 has an opening aligned with the nozzle hole 311*a* and the opening 327 in the masking plate 326, thereby to allow liquid to be dispensed therethrough in the direction of an object 338 to be coated, such as a can, as shown in FIG. 21.

In operation, liquid or other coating material is supplied to the gun 301 through liquid supply apperture 304, while atomization gas is supplied via atomization gas hole 313. When needle valve 305 is opened by operation of operational air supplied via air supply aperture 306, the coating material is sprayed out of nozzle opening 311*a* and preferably atomized by the atomization gas flowing outwardly from gas spray hole 314.

The sprayed stream is deflected by gas flows from the blowout ports 315*a*, in accordance with a predetermined timing sequence in order to form a predetermined pattern or coating distribution, as described previously.

In coating some objects, such as a can 338, the air supplied by the gun 301 has little room for escape, due to the enclosed contour of the can 338, and therefore the possibility of liquid reflection or rebound out of the can is greater. To prevent reflection of dispensed material onto the front end of the deflection nozzle 310, positive pressure gas is supplied via passages 316 into the positive pressure chamber 330. The gas pressure within chamber 330 prevents reflected coating particles from accumulating on the front end of the deflection nozzle 310, since the pressure within chamber 330 is greater than the pressure externally thereof.

Some of the reflected coating material may instead adhere to the outside surface of the masking plate 326. For this reason, the masking plate 326 is rotated by operation of the motor 331. This causes any coating material which has adhered to the surface of the masking plate 326 to be spun off of plate 326 by centrifugal force. In some cases, particularly wherein the coating material has high adherence properties, the centrifugal force may not be sufficient to prevent continued adhesion of reflected coating material onto the masking plate 326. Therefore, cleaning solution is sprayed from the spray nozzles 334 against the outer surface of the masking plate 326 as it rotates.

FIGS. 21 and 22 show two spray nozzles 334, with one located radially inside of the other, for cleaning the external surface of the plate 326. Additional such nozzles 334 may be used, if desired. Preferably, the external surface of the masking plate 326 is coated with a fluororesin which has superior water repellency, or a mirror finishing, so that the coating material does not easily adhere thereto.

The cover 335 prevents contamination of the coating environment, and particularly the object 338 to be coated. The cover 335 catches the coating material which is spun off of the masking plate 326 during rotation thereof. The vaporized portion of the scattered coating material is discharged through exhaust apperture 336, while the liquid portion is discharged via liquid discharge apperture 337.

FIG. 23 shows the front end of the deflection nozzle 310, and specifically shows the relative positions of the nozzle hole 311*a*, the atomization spray hole 314, the blowout ports 315*a* and the positive pressurization passages 316.

Using the structure shown in FIGS. 21, 22 and 23, applicant carried out the following example, designated as Example 1:

Object to the coated—cans, having one open end and one closed end, carried by a conveyor operating at the rate of 120 to 400 cans per minute.

Rotational speed of the motor 331—300 to 1,500 RPM.

Positive pressurization air (via passages 316)—1.0 to 3.0 $kg/cm^2$.

Pressure of atomization air (via atomization hole 314)—1.0 to 2.5 $kg/cm^2$.

Pressure of the deflection air (via blowout ports 315*a*)—1.0 to 3.0 $kg/cm^2$.

Cleaning solution applied intermittently and in small quantities to maintain the masking plate 326 in a normally wet condition.

The above-stated conditions were used to successively coat the inside surfaces of 54,000 cans. Uniform thickness of coating film was attained on the inside of the cans, and there was no adhesion of the coating material to the masking plate 326 or the deflection nozzle 310.

With the additional structural components shown in FIGS. 21, 22 and 23, this feature of the invention facilitates uniform and stable coating of the inside surfaces of cans, or other objects particularly susceptible to reflection of sprayed coating particles. Moreover, it does so in a manner which leaves no coating material on the masking equipment and maintains an uncontaminated coating environment around the outside of the dispensing apparatus, thereby facilitating continuous coating operations for a long period of time without stoppage.

From the above disclosure of the general principles of the present invention and preceding detailing description of the preferred embodiments, those skilled in the art will readily comprehend the various modifications to which the present invention is susceptible. Therefore, we desire to be limited only by the scope of the following claims and equivalent thereof:

We claim:

1. A method of uniformly coating the inside surface of a can comprising the steps of:

(a) spraying a stream of coating material from a nozzle toward the inside surface of the can; and (b) directing each of a plurality of independently actuatable air flows radially inward into contact with the sprayed stream to deflect the stream in a sequence of directions to uniformly coat a non-linear portion of the inside surface of the can without producing a spray reflection.

2. The method of claim 1 further comprising the steps of:

performing steps (a) and (b) with the nozzle inside the can and then moving the nozzle relative to the can to uniformly coat additional portions of the inside surface of the can.

3. A method of uniformly coating the inside surface of a can comprising the steps of:

(a) spraying a stream of coating material from a nozzle toward the inside surface of the can;

(b) directing each of a plurality of independently actuatable air flows radially inward into contact with the sprayed stream to deflect the stream in a sequence of directions to uniformly coat a non-linear portion of the inside surface of the can without producing a spray reflection; and (c) repeating said spraying, directing and moving steps a number of times to uniformly coat the entire surface of the can in a series of steps, wherein one cycle of spraying and directing occurs during each of the steps and each cycle has a duration of about 120 milliseconds.

4. The method of claim 3 wherein the gas flows are directed radially inwardly from six external blowout ports and each cycle further comprises:

deflecting the stream with six gas flows, each gas flow having a duration of about 20 milliseconds.

5. The method of claim 1 wherein steps (a) and (b) are performed at a first stage with the nozzle located outside the can and directed toward a level in the can and further comprising the steps of:

performing steps (a) and (b) again at additional stages, each additional stage equipped with a nozzle directed toward a different level in the can, thereby to uniformly coat the entire inside surface of the can without inserting any of the nozzles into the can.

6. The method of claim 1 wherein the sprayed and deflected stream is liquid.

7. The method of claim 1 wherein the sprayed and deflected stream is powder.

8. The method of claim 1 and further comprising the steps of:

locating a masking plate between the nozzle and the can, the masking plate having an opening aligned with the nozzle to allow passage of the sprayed stream therethrough and defining a space between the plate and the nozzle; and supplying pressurized air into the space during spraying, thereby to discourage entry of reflected spray into the space and to prevent accumulation of reflected spray at the end of the nozzle.

9. The method of claim 8 and further comprising the step of:

rotating the masking plate to minimize accumulation of reflected liquid on an external surface thereof.

10. The method of claim 9 and further comprising the steps of:

spraying a cleaning solution from at least one cleaning nozzle against the masking plate during rotation thereof to further minimize the accumulation thereon of reflected liquid; and collecting, via a cover surrounding the masking plate, the cleaning solution after contact with the masking plate, thereby to prevent the cleaning solution from contacting the can.

11. The method of claim 8 wherein the masking plate is coated with a material which reduces the adherence of coating material to the masking plate.

12. A method of dispensing comprising the steps of:

flowing a stream of coating material from a dispensing orifice of a nozzle toward the interior surface of a hollow product; and intermittently deflecting the stream with a plurality of independently actuatable air flows from a plurality of blowout ports located around the periphery of the dispensing orifice, thereby to achieve a distribution pattern on the interior surface of the hollow product, wherein the flowed and deflected stream is powder.

13. The method of claim 12 wherein the hollow product is a metal can with one open end and the stream is flowed and deflected to uniformly coat the entire interior surface of the sides and closed end of the can.

14. A method of dispensing comprising the steps of:

flowing a stream of coating material from a dispensing orifice of a nozzle toward the interior surface of a hollow product;

intermittently deflecting the stream with a plurality of independently actuatable air flows from a plurality of blowout ports located around the periphery of the dispensing orifice, thereby to achieve a distribution pattern on the interior surface of the hollow product;

locating a masking plate between the nozzle and the hollow product, the masking plate having an opening aligned with the dispensing orifice to allow passage of the stream therethrough and defining a space between the plate and the nozzle; and supplying pressurized air into the space during dispensing, thereby to discourage entry of reflections of said stream into the space and to prevent accumulation of said reflections at the end of the nozzle.

15. The method of claim 14 and further comprising the step of:

rotating the masking plate to minimize accumulation of reflected liquid on an external surface thereof.

16. The method of claim 15 and further comprising the steps of:

spraying a cleaning solution from at least one cleaning nozzle against the masking plate during rotation thereof to further minimize the accumulation thereon of reflected liquid; and collecting, via a cover surrounding the masking plate, the cleaning solution after contact with the masking plate, thereby to prevent the cleaning solution from contacting the can.

17. A method of dispensing comprising the steps of:

flowing a stream of coating material from a dispensing orifice and a nozzle toward a substrate;

intermittently deflecting the stream with a plurality of independently actuatable air flows from a plurality of blowout ports located around the periphery of the dispensing orifice; thereby to achieve a distribution pattern on the substrate;

locating a masking plate between the nozzle and the substrate, the masking plate having an opening aligned with the dispensing orifice to allow passage of the stream therethrough and defining a space between the plate and the nozzle; and supplying pressurized air into the space during flowing, thereby to discourage entry of reflections from the dispensed stream into the space and to prevent accumulation of said reflections at the end of the nozzle.

18. The method of claim 17 wherein the independently actuatable flows are gas flows from a source of pressurized gas.

19. The method of claim 17 and further comprising the step of:

coordinating the flowing of the stream with a desired sequence and duration of directional flows from the blowout ports to achieve said distribution pattern on the substrate.

20. A method of dispensing comprising the steps of:

flowing a stream from a dispensing orifice and a nozzle toward a substrate; and selectively deflecting the stream with a plurality of independently actuatable air flows from a plurality of blowout ports located around the periphery of the dispensing orifice; thereby to achieve a desired distribution pattern on the substrate, wherein the stream comprises a mixture of air-entrained powder particles for powder coating the substrate, and wherein the air-entrained particles are electrostatically charged prior to deflection.

21. The method of claim 20 and further comprising the step of:

rotating the masking plate to eliminate accumulation of reflected liquid on an external surface thereof.

22. The method of claim 21 and further comprising the steps of:

spraying a cleaning solution from at least one cleaning nozzle against the masking plate during rotation thereof to further minimize the accumulation thereon of reflected liquid; and collecting, via a cover surrounding the masking plate, the cleaning solution after contact with the masking plate, thereby to prevent the cleaning solution from contacting the can.

23. A method of dispensing liquid comprising the steps of:

flowing a liquid stream of coating material from a dispensing orifice of a nozzle toward a substrate;

flowing a second liquid stream from a second orifice in the nozzle to combine said flowed liquids from both orifices in a mixed liquid stream; and intermittently deflecting the mixed liquid stream with a plurality of independently actuatable flows from a plurality of blowout ports located around the periphery of the dispensing orifice; thereby to achieve a distribution pattern of the dispensed liquid on the substrate wherein the actuatable flows are one of the following types of flows, air and aerosol.

24. The method of claim 23 wherein said liquid is an aerosol spray.

25. The method of claim 23 wherein said second liquid is a hardening agent.

26. The method of claim 25 wherein said second aerosol liquid stream is demineralized water and said first flowed liquid stream is liquid nitrogen.

27. The method of claim 23 wherein said first and second liquids are demineralized water and liquid nitrogen, respectively.

28. The method of claim 23 and further comprising the step of:

atomizing the mixed liquid stream with an atomizing flow from a third concentric orifice in the nozzle located exteriorly of the first and second orifices and inside of the blowout ports.

29. The method of claim 23 wherein said second liquid stream flowing step further comprises:

spraying an aerosol from a second orifice concentric about the first orifice.

30. The method of claim 29 wherein said second aerosol liquid stream is a hardening agent.

31. The method of claim 23 wherein the deflecting flows are aerosols of different liquids.

32. The method of claim 23 and further comprising the steps of:

locating a masking plate between the nozzle and the can, the masking plate having an opening aligned with the dispensing orifice to allow passage of the sprayed stream therethrough and defining a space between the plate and the nozzle; and supplying pressurized air into the space during spraying, thereby to discourage entry of reflected spray into the space and to prevent accumulation of reflected spray at the end of the nozzle.

33. The method of claim 32 and further comprising the step of:

rotating the masking plate to minimize accumulation of reflected liquid on an external surface thereof.

34. The method of claim 33 and further comprising the steps of:

spraying a cleaning solution from at least one cleaning nozzle against the masking plate during rotation thereof to further minimize the accumulation thereon of reflected liquid; and collecting, via a cover surrounding the masking plate, the cleaning solution after contact with the masking plate, thereby to prevent the cleaning solution from contacting the can.

* * * * *

UNITED STATES PATENT AND TRADEMARK OFFICE

CERTIFICATE OF CORRECTION

PATENT NO. : 5,800,867

DATED : September 1, 1998

INVENTOR(S) : Masafumi Matsunaga et al.

It is certified that error appears in the above-identified patent and that said Letters Patent is hereby corrected as shown below:

Column 4, line 62, change "FIG." to --FIGS.--.

Column 5, line 1, insert --Figs. 17A, 17B, 17C, 17D and 17E depict additional dot distribution patterns obtainable with the gun of Fig. 1

Column 6, line 17, change "value" to --valve--.

Column 9, line 42, change "or" (second occurrence) to --of-- and "98" to --97-- and in line 62, change "in" to --is--.

Column 10, line 40, before "is" insert --it--.

Column 11, line 38, change "fees" to --feeds--.

Column 13, line 36, change "apperture" to --aperture-- and in line 43, change "apperture" to --aperture--.

Column 14, line 23, change "apperture" to --aperture--, in line 24, change "apperture" to --aperture-- and in line 32, change "the" to --be--.

Claim 4, column 15, line 33, change "gas" to --air-- and in line 36, change "gas" to --air-- in both occurrences.

UNITED STATES PATENT AND TRADEMARK OFFICE

CERTIFICATE OF CORRECTION

PATENT NO. : 5,800,867

DATED : September 1, 1998

INVENTOR(S) : Masafumi Matsunaga et al.

It is certified that error appears in the above-identified patent and that said Letters Patent is hereby corrected as shown below:

Claim 18, column 17, line 13, change "gas" to --air-- and in line 14, change "gas" to --air--

Signed and Sealed this

Sixth Day of April, 1999

*Attest:*

Q. TODD DICKINSON

*Attesting Officer*

*Acting Commissioner of Patents and Trademarks*